US010502215B2

(12) United States Patent
Henry et al.

(10) Patent No.: US 10,502,215 B2
(45) Date of Patent: Dec. 10, 2019

(54) BLOWER ASSEMBLY KIT, DEVICE KIT AND ASSOCIATED METHOD

(71) Applicant: Regal Beloit America, Inc., Beloit, WI (US)

(72) Inventors: Joseph Aaron Henry, Riverside, OH (US); Sahand Pirouzpanah, Miamisburg, OH (US); Shirish M Vatkar, Tipp City, OH (US)

(73) Assignee: Regal Beloit America, Inc., Beloit, WI (US)

( * ) Notice: Subject to any disclaimer, the term of this patent is extended or adjusted under 35 U.S.C. 154(b) by 287 days.

(21) Appl. No.: 15/585,852

(22) Filed: May 3, 2017

(65) Prior Publication Data

US 2018/0320697 A1 Nov. 8, 2018

(51) Int. Cl.

| | |
|---|---|
| ***F04D 29/26*** | (2006.01) |
| ***F04D 17/16*** | (2006.01) |
| ***F04D 29/28*** | (2006.01) |
| ***F04D 25/06*** | (2006.01) |
| ***F04D 29/62*** | (2006.01) |

(52) U.S. Cl.

CPC ..... *F04D 17/16* (2013.01); *F04D 17/162* (2013.01); *F04D 25/06* (2013.01); *F04D 29/263* (2013.01); *F04D 29/282* (2013.01); *F04D 29/283* (2013.01); *F04D 29/626* (2013.01)

(58) Field of Classification Search

CPC ..... F04D 17/16; F04D 29/283; F04D 29/626; F04D 29/263; F04D 29/282

USPC ..... 416/205

See application file for complete search history.

(56) References Cited

U.S. PATENT DOCUMENTS

| | | | | |
|---|---|---|---|---|
| 4,220,880 | A | 9/1980 | Woodard | |
| 4,260,125 | A * | 4/1981 | Levine | H02K 5/26 248/675 |
| 5,492,456 | A | 2/1996 | Knight et al. | |
| 5,772,176 | A | 6/1998 | Keck et al. | |
| 6,761,343 | B2 | 7/2004 | Clark et al. | |
| 7,455,500 | B2 * | 11/2008 | Penlesky | F04D 29/4226 415/206 |
| 7,513,754 | B2 | 4/2009 | Clark et al. | |

(Continued)

FOREIGN PATENT DOCUMENTS

| | | | | |
|---|---|---|---|---|
| AU | 199226046 | A | 9/1992 | |
| CA | 2047576 | C | 9/2002 | |
| DE | 102004063920 | A1 * | 12/2005 | H02K 5/06 |

*Primary Examiner* — J. Todd Newton

(74) *Attorney, Agent, or Firm* — Regal Beloit America, Inc.; John S. Wagley

(57) ABSTRACT

A blower assembly kit for fabricating a plurality of blower assemblies is provided. A first of the plurality of blower assemblies is configured for use with a first motor having a rotor and a second of the plurality of blower assemblies is configured for use with a second motor having a shaft. The kit includes a body having a member for generating air flow, a first adapter having a first connection for connecting the first adapter to the body and a second connection for connecting the first adapter to the rotor of the first motor, and having a second adapter having a first connection connecting the second adapter to the body and a second connection connecting the second adapter to the shaft of the second motor. The body and the first adapter provide the first blower assembly and the body and the second adapter provide the second blower assembly.

20 Claims, 18 Drawing Sheets

(56) References Cited

U.S. PATENT DOCUMENTS

| | | | | |
|---|---|---|---|---|
| 7,781,926 | B2 * | 8/2010 | Schmidt | H02K 5/06 310/77 |
| 2007/0044499 | A1 * | 3/2007 | Reilly, Jr. | F24F 13/00 62/298 |
| 2012/0132783 | A1 | 5/2012 | Jia | |
| 2016/0111816 | A1 * | 4/2016 | Walker | F04D 25/0693 417/423.7 |
| 2017/0342990 | A1 * | 11/2017 | Martens | F03G 7/10 |
| 2018/0023581 | A1 * | 1/2018 | Karst | F04D 25/166 415/213.1 |
| 2018/0194544 | A1 * | 7/2018 | Tarr | F04D 29/646 |
| 2018/0320697 | A1 * | 11/2018 | Henry | F04D 17/16 |

* cited by examiner

BLOWER ASSEMBLY KIT, DEVICE KIT AND ASSOCIATED METHOD

BACKGROUND OF THE INVENTION

The field of the invention relates generally to blower assemblies used in HVAC (Heat, Ventilation, and Air Conditioning).

A blower assembly typically includes a blower, a motor to propel the blower, and a housing for supporting the motor and for direction the flow of air from the blower. The blower typically rotates and, as such is connected to the rotating portion or rotor of the motor. The rotor may be connected to the blower at any suitable interface and the rotor may, for example, include a body that is mounted to the blower or may include a shaft to which the blower is mounted.

Further, a plurality of different motors may be utilized with a plurality of different blowers to provide the blower assembly. It may be desirable to provide a plurality of different motors to a common blower, or conversely, it may be desirable to provide a plurality of different blowers to a common motor.

The use of different motor mounting configurations and the use of different blowers and the use of different motors in blower assemblies in HVAC adds to the complexity and associated costs of such assemblies.

Attempts to connect and seal a blower outlet to a HVAC related appliances may not be effective and may be expensive. Reducing the complexity of motor and blowers and the reduction in the proliferation of parts is desirable in the design and manufacture of blower assemblies.

The present invention is directed to alleviate at least some of these problems with the prior art.

BRIEF DESCRIPTION OF THE INVENTION

According to an embodiment of the invention, a blower assembly kit for fabricating a plurality of blower assemblies is provided. A first of the plurality of blower assemblies is configured for use with a first motor having a rotor. A second of the plurality of blower assemblies is configured for use with a second motor having a shaft.

The kit includes a body having a member for generating airflow and a first adapter having a first connection for connecting the first adapter to the body and having a second connection for connecting the first adapter to the rotor of the first motor. The kit also includes a second adapter having a first connection for connecting the second adapter to the body and having a second connection for connecting the second adapter to the shaft of the second motor. The body and the first adapter include the first of the plurality of blower assemblies and the body and said second adapter include the second of the plurality of blower assemblies.

According to an aspect of the invention, the blower assembly kit may be configured such that the second adapter includes a first member having the first connection and a second member, connected to the first member and including the second connection.

According to another aspect of the invention, the blower assembly kit may be configured such that the first member of the first adapter is integral with the second adapter.

According to yet another aspect of the invention, the blower assembly kit may be configured such that the first adapter and the second adapter are integral with each other.

According to another aspect of the invention the blower assembly kit may be configured such that the first motor is an axial flux motor.

According to another aspect of the invention the blower assembly kit may be configured such that the second motor is a radial flux motor.

According to another aspect of the invention the blower assembly kit may be configured such that the second connection of the second adapter includes a hub defining a central opening for receiving the shaft.

According to another aspect of the invention, the blower assembly kit may further include a fastener. The second connection of the first adapter includes an opening for receiving the fastener.

According to another aspect of the invention, the blower assembly kit may further include a plurality of fasteners and may be configured such that the second connection of the first adapter includes a plurality of spaced apart openings. Each of the openings may be adapted for receiving at least one of the fasteners. The rotor may include a plurality of spaced apart openings. Each of the openings may be adapted for receiving at least one of the fasteners.

According to an aspect of the invention the blower assembly kit may be configured such that the body includes a blower wheel and wherein the member includes a blower blade.

According to an aspect of the invention the blower assembly kit may be configured such that the body comprises a fan body and such that the member includes a fan blade.

According to another embodiment of the invention a device kit for fabricating a plurality of blower devices is provided. The kit includes a first motor having a rotor, a second motor having a shaft, a body including a member for generating airflow, a first adapter and a second adapter. The first adapter has a first connection for connecting the first adapter to the body and has a second connection for connecting the first adapter to the rotor of the first motor. The second adapter has a first connection for connecting the second adapter to the body and has a second connection for connecting the second adapter to the shaft of the second motor. The body, the first adapter and the first motor include a first of the plurality of blower assemblies and the body, the second adapter and the second motor include the second of the plurality of blower assemblies.

According to an aspect of the invention the device kit may be configured such that the second adapter includes a first member having the first connection and a second member, connected to the first member and including the second connection.

According to an aspect of the invention the device kit may be configured such that the first adapter and the second adapter are integral with each other.

According to an aspect of the invention the device kit may be configured such that the first member of the first adapter is integral with the second adapter According to an aspect of the invention the device kit may be configured such that the first motor is an axial flux motor.

According to an aspect of the invention the device kit may be configured such that the second motor is a radial flux motor.

According to an aspect of the invention the device kit may be configured such that the second connection of the second adapter includes a hub defining a central opening for receiving the shaft.

According to an aspect of the invention the device kit may be configured such that the rotor includes a plurality of spaced apart openings. Each opening is adapted for receiving at least one of the fasteners.

According to another embodiment of the present invention a method for providing a plurality of blower devices is provided. The method includes the steps of providing a first motor having a rotor, providing a second motor having a shaft, providing a body including a member for generating air flow, providing a first adapter having a first connection for connecting the first adapter to the body and having a second connection for connecting the first adapter to the rotor of the first motor, providing a second adapter having a first connection for connecting the second adapter to the body and having a second connection for connecting the second adapter to the shaft of the second motor, assembling the first adapter to the first motor to provide a first of the plurality of blower assemblies, and assembling the second adapter to the second motor to provide a second of the plurality of blower assemblies.

According to another embodiment of the present invention a method for providing a plurality of blower devices is provided. The method includes the steps of providing a first motor having a rotor, providing a second motor having a shaft, providing a body including a member for generating air flow, providing a first adapter having a first connection for connecting the first adapter to the body and having a second connection for connecting the first adapter to the rotor of the first motor, providing a second adapter having a first connection for connecting the second adapter to the body and having a second connection for connecting the second adapter to the shaft of the second motor, assembling the first adapter to the first motor to provide a first of the plurality of blower assemblies, and assembling the second adapter to the second motor to provide a second of the plurality of blower assemblies.

DETAILED DESCRIPTION OF THE INVENTION

The method, systems and apparatus described herein provide for a HVAC blower assembly kit and a device kit with reduced cost.

A HVAC blower assembly typically includes a blower, a motor to propel the blower, and a housing for supporting the motor and for direction the flow of air from the blower. The blower typically rotates and, as such is connected to the rotating portion or rotor of the motor. The rotor may be connected to the blower at any suitable interface and the rotor may, for example, include a body that is mounted to the blower or may include a shaft to which the blower is mounted.

Further, a plurality of different motors may be utilized with a plurality of different blowers to provide the HVAC blower assembly. It may be desirable to provide a plurality of different motors to a common blower, or conversely, it may be desirable to provide a plurality of different blowers to a common motor.

The use of different motor mounting configurations and the use of different blowers and the use of different motors in HVAC blower assemblies adds to the complexity and associated costs of such assemblies used in HVAC industry.

Attempts to connect and seal a HVAC blower outlet to HVAC related appliances may not be effective and may be expensive. Reducing the complexity of motor and blowers and the reduction in the proliferation of parts or components is desirable in the design and manufacture of blower assemblies. The method, systems and apparatus described herein facilitate combining a minimum of different parts or components to provide for the variety of blower assembly options that the market place demands. The designs and methods provided herein facilitate reduction in complexity, manufacturing costs and inventory cost related to providing a wide variety of blower assemblies.

Technical effects of the methods, systems, and apparatus described herein include at least one of reduced cost, a larger variety of product options, improved performance and quality and reduced labor costs.

Figure 1:
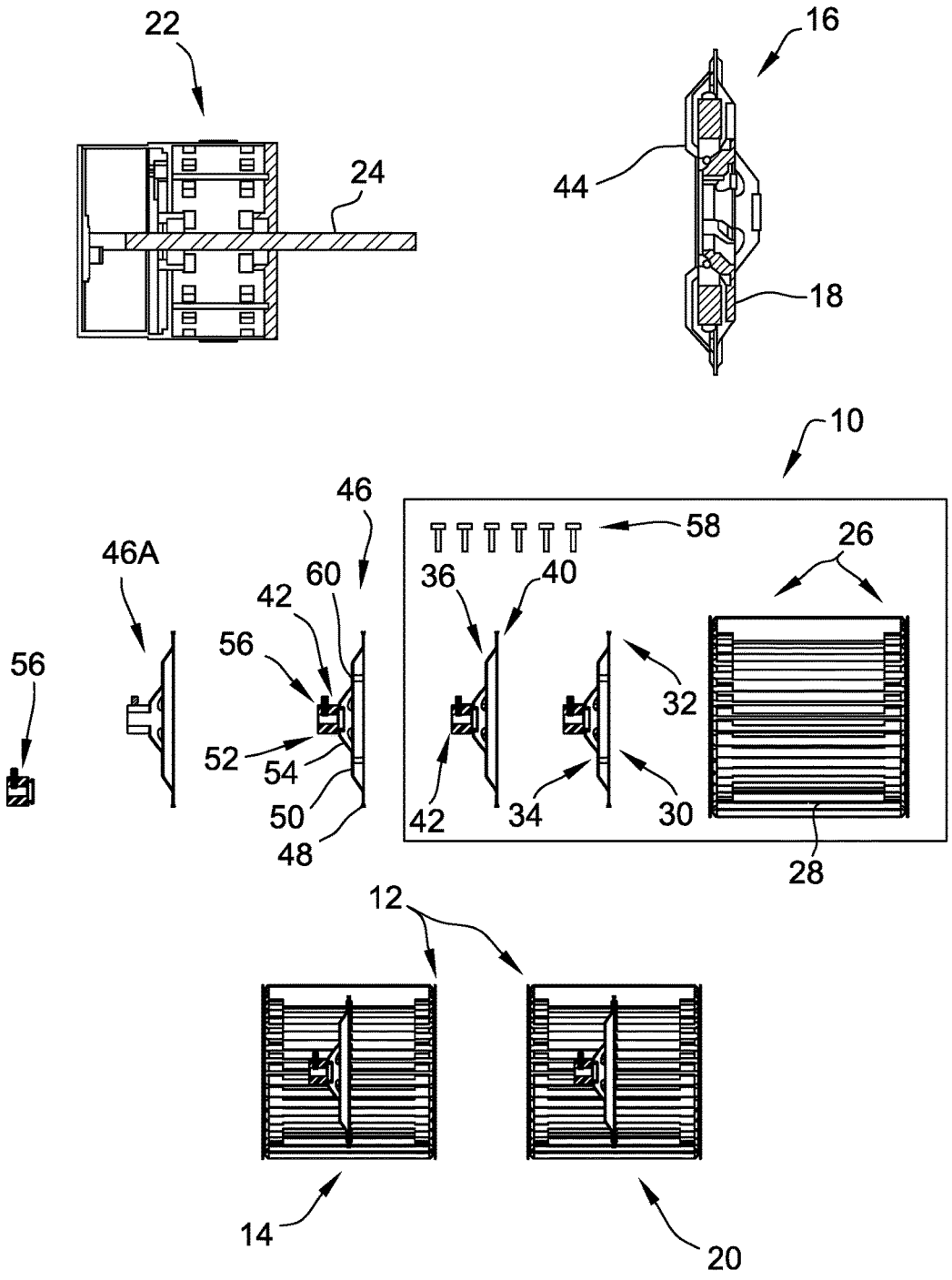
FIG. 1 is a plan view of a blower assembly kit including a blower, a first adapter and a second adapter, according to an embodiment of the present invention.

Referring to FIG. 1 and according to an embodiment of the invention, a blower assembly kit 10 for fabricating a plurality of blower assemblies 12 is provided. A first 14 of the plurality of blower assemblies 12 is configured for use with a first motor 16 having a rotor 18. A second 20 of the plurality of blower assemblies 12 is configured for use with a second motor 22 having a shaft 24.

The kit 10 includes a body 26 having a member 28 for generating air flow and a first adapter 30 having a first connection or body connection 32 for connecting the first adapter 30 to the body 26 and having a second connection or rotor connection 34 for connecting the first adapter 30 to the rotor 18 of the first motor 16.

The kit 10 also includes a second adapter 36 having a first connection or body connection 40 for connecting the second adapter 36 to the body and having a second connection or shaft connection 42 for connecting the second adapter 36 to the shaft 24 of the second motor 22. The body 26 and the first adapter 30 include the first 14 of the plurality of blower assemblies 12 and the body 26 and said second adapter 36 include the second 20 of the plurality of blower assemblies 12.

The body 26, the first adapter 30 and the member 28 form the first blower assembly 14. The body 26, the second adapter 36 and the member 28 form the second blower assembly 20. The first adapter 30 and the second adapter 36 may be in the form of a center plate that serves to support the body 26. The center plate 30, 36 and the body 26 may be in the form of a fan or blower, for example a cylindrically shaped blower with a uniformly spaced set of members for moving fluid in the form of blades or fins. The fluid may be a liquid or a gas and is typically air. The cylindrically shaped blower is also known as a squirrel cage fan or blower. This type of blower is typically used in heating, cooling or air moving applications in buildings, both commercial and residential. This type of blower is well suited for use in heating and cooling building applications where ductwork is installed in the building and forced air cooling and heating is used.

It should be appreciated that the blower assembly kit 10 is well suited for applications where the second motor 22 is different from the first motor 16 and where there is a desire to rotate the rotate the body 26 to generate airflow with a selected one of the first motor 16 and the second motor 22. Further, the blower assembly kit 10 is well suited for applications where the first motor 16 is so different from the second motor 22 that a common location in the motors 16 and 22 cannot be reasonably obtained to secure the motor to the body.

It should be appreciated that the first motor 16 and/or the second motor 22 may be an axial flux motor or a radial flux motor. The motors 16 and/or 22 may be induction motors, permanent magnet motors, PSC motors, or switched reluctance motors.

One such situation in which the first motor 16 is so different from the second motor 22 that a common mounting configuration is not practical is when the first motor 16, as shown, is a axial flux motor and when the second motor 22, as shown, is a radial flux motor.

The second connection or rotor connection 34 for connecting the first adapter 30 to the rotor 18 of the first motor 16 may have any suitable configuration. Typically and as shown in FIG. 1, the second connection or rotor connection 34 may include mounting holes 44 in the rotor 18 for mounting rotor 18 to the body 26.

Typically and as shown in FIG. 1, the second motor 22 utilizes the shaft 24 to connect the motor 22 to the body 26.

While the first adapter 30 and the second adapter 36 may be separate components, as shown in FIG. 1 the first adapter 30 and the second adapter 36 may be integral with each other. In such a configuration, the first adapter 30 and the second adapter 36 may be in the form of common adapter 46.

The common adapter 46 may, as shown in FIG. 1, include a body connector 48 which connects the adapter 46 to the body 26, an axial flux motor or rotor connector 50 for connecting the adapter to the axial flux motor 16, and a radial flux motor or shaft connector 52 for connecting the adapter to the radial flux motor 22.

Note that the radial flux motor connector 52 may be similar or identical to the second or shaft connection 42 of second adapter 36 for connecting the second adapter 36 to the shaft 24 of the second motor 22. Note that the axial flux motor connector 50 may be similar or identical to the second or rotor connection 34 of first adapter 30 for connecting the first adapter 30 to the rotor 18 of the first motor 16

Note that the body connector 48 may be similar or identical to the first or body connection 40 of second adapter 36 for connecting the second adapter 36 to the body 26 and similar or identical to the first or body connection 32 of first adapter 30 for connecting the first adapter 30 to the body 26.

For example and as shown in FIG. 1, the common adapter 46 may be in the form of an integral component 46A. Alternatively, and as shown in FIG. 1, the common adapter 46 may be made from a plurality of separate components. For example, the common adapter 46 may include a flange 54 to which the body 26 and the axial motor 22 may be secured and a hub 56 extending centrally axially outwardly from the flange 54. The hub 56 may secure the shaft 24 of the radial motor 16.

As shown in FIG. 1, the blower assembly kit 10 may further include fasteners 58. The fasteners 58 may fit into mounting holes 60 in the flange 54 of the adaptor 46. The fasteners 58 may be threaded and may threadably engage the mounting holes 44 in the rotor 18 for securing the rotor 18 to the adaptor 46.

As shown in FIG. 1, the body 26 and the member 28 of the blower assembly kit 10 may have any configuration capable of generating airflow. For example, the body 26 may be a blower or fan. If the body is a fan (not shown), the member 28 may be a fan blade (not shown) of the fan. As shown in FIG. 1, the member may be a blower 28 and the member may be a blower blade 28.

The blower 28 may be any device that generates airflow and may, for example and as is shown in FIG. 1, be a cylindrical blower with blades or fins extending axially along the cylindrical periphery of the blower. Such blowers are typically called squirrel cage blowers and are used in many air moving application including furnace blowers and air handlers.

Squirrel cage blowers may have many configuration or orientation of blades or fins and may be forward or backwardly inclining and may be curved or straight. The kit 10 of the present invention is applicable for a wide variety of blower and fan configurations.

Figure 2:
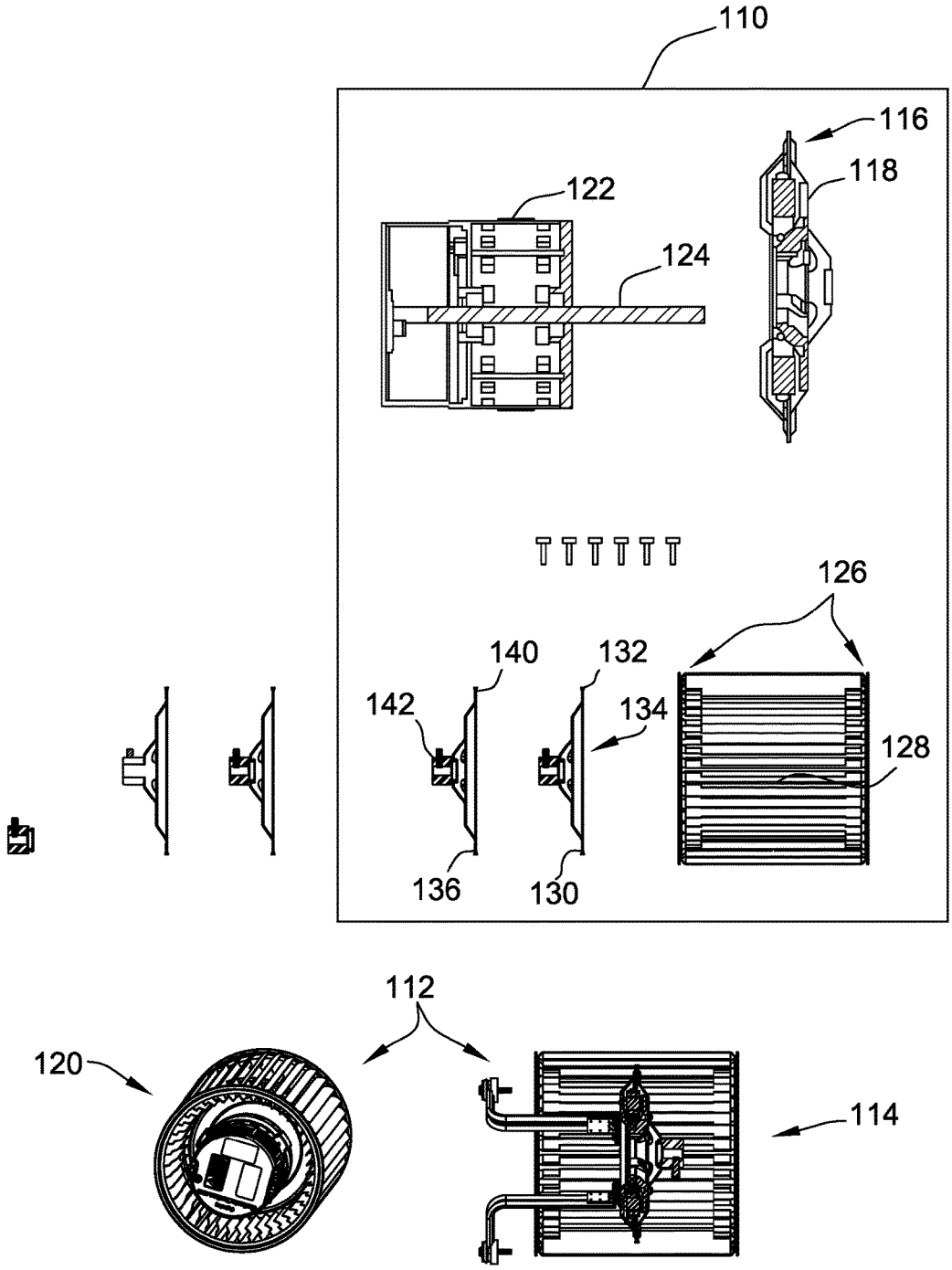
FIG. 2 is a plan view of a device kit including a first motor, a second motor, a blower, a first adapter and a second adapter, according to an embodiment of the present invention.

According to another embodiment of the invention and referring to FIG. 2, a device kit 110 for fabricating a plurality of blower devices 112 is provided. The device kit 110 is similar to the kit 10 of FIG. 1, except the kit 110 also includes the motors.

Referring to FIG. 2, kit 110 includes a first motor 116 having a rotor 118, a second motor 122 having a shaft 124, a body 126 including a member 128 for generating air flow, a first adapter 130 and a second adapter 136. The first adapter 130 has a first connection 132 for connecting the first adapter 130 to the body 126 and has a second connection 134 for connecting the first adapter 130 to the rotor 118 of the first motor 116. The second adapter 136 has a first connection 140 for connecting the second adapter 136 to the body 126 and has a second connection 142 for connecting the second adapter 136 to the shaft 124 of the second motor 122. The body 126, the first adapter 130 and the first motor 116 include a first 114 of the plurality of blower assemblies 112 and the body 126, the second adapter 136 and the second motor 122 include the second 120 of the plurality of blower assemblies 112. It should be appreciated that the elements 110 to 142 of FIG. 2 may be similar or identical to the respective elements 10 to 42 of FIG. 1.

Figure 3:
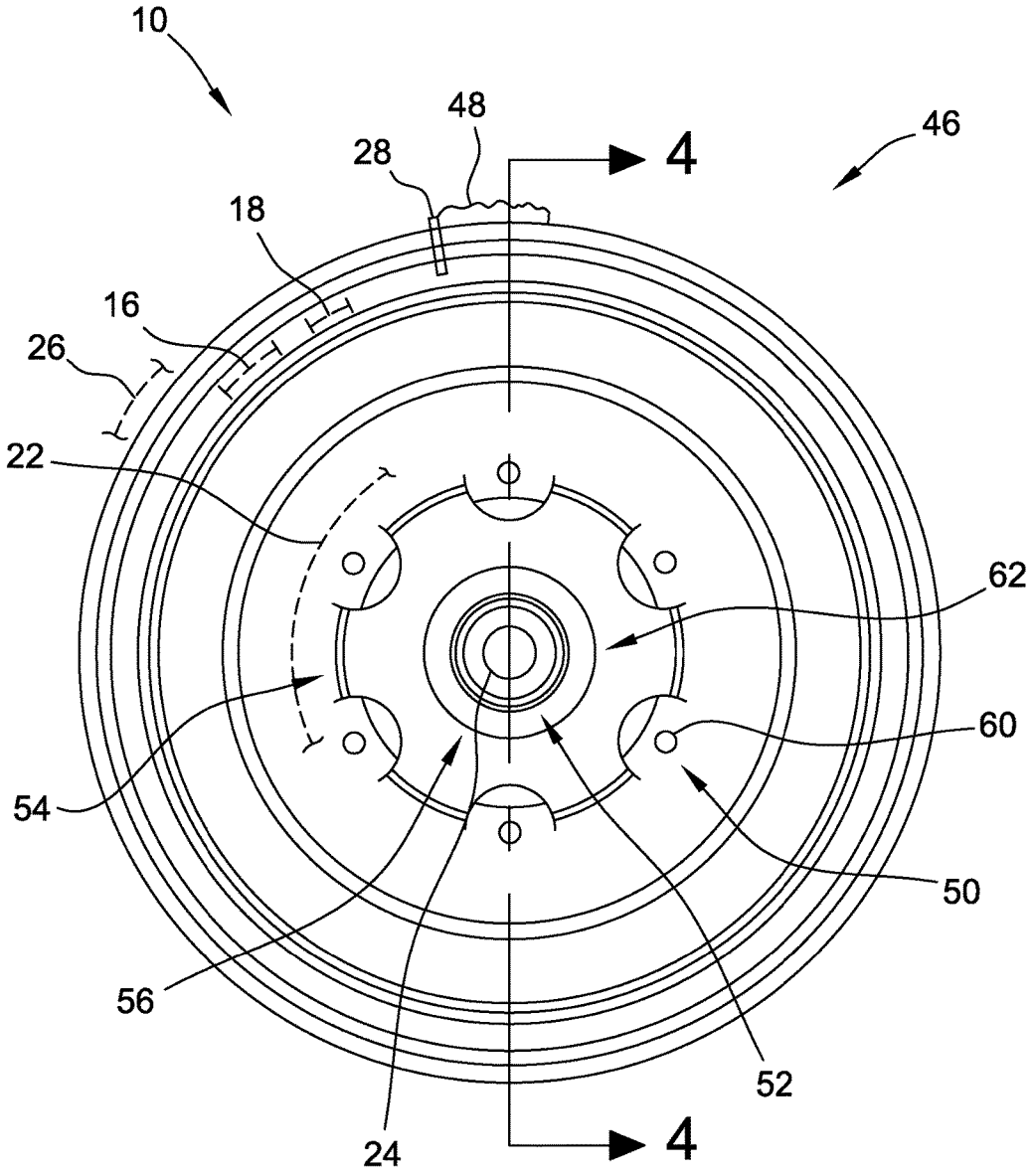
FIG. 3 is a plan view of the adapter of FIG. 2.
Figure 4:
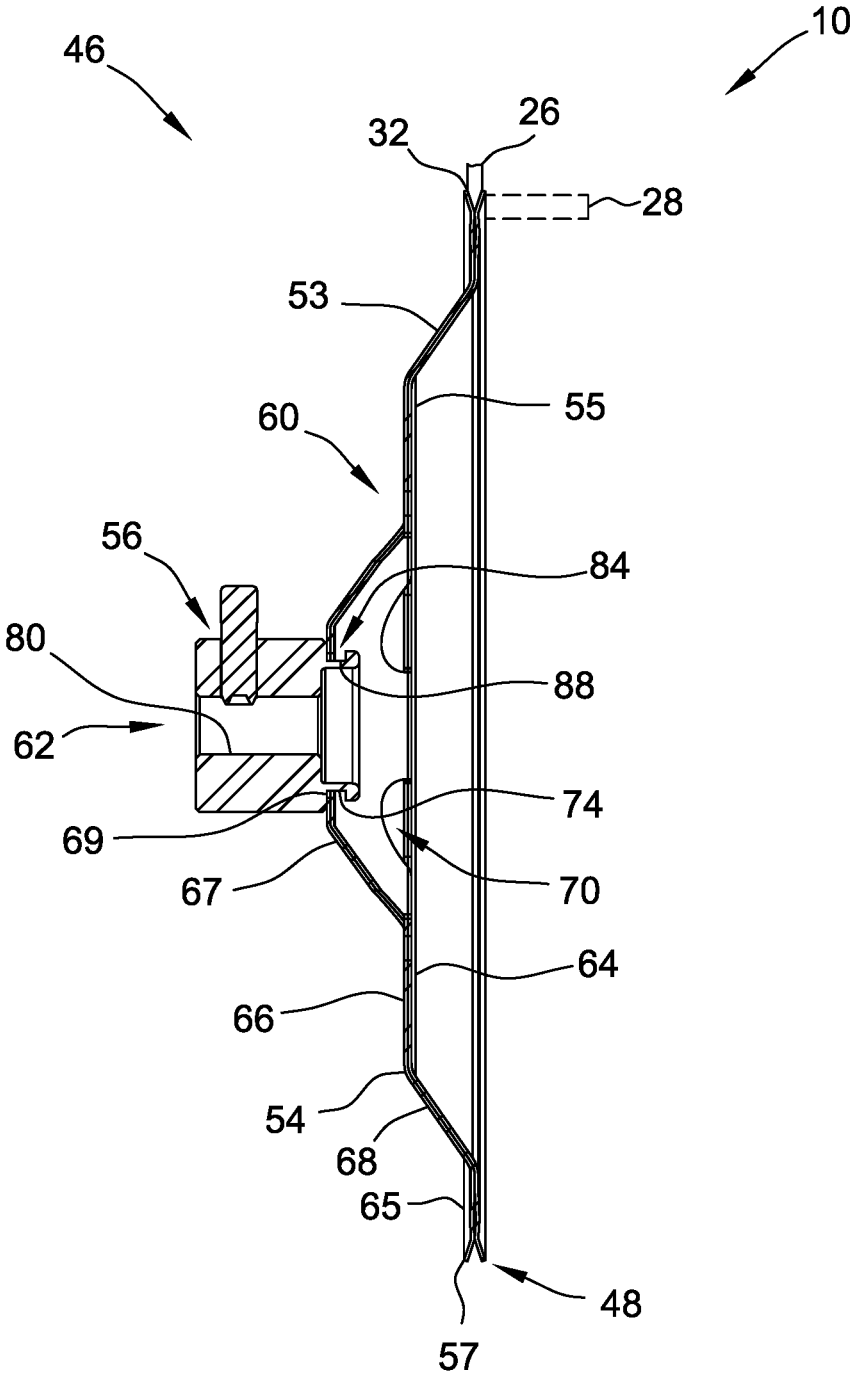
FIG. 4 is a cross sectional view of the adapter of FIG. 3 along the line 4-4 in the direction of the arrows.

Referring now to FIGS. 3 and 4, the common adapter 46 is shown in detail. The common adapter 46 may have any suitable shape and be made of any suitable durable material capable of securing a selected one of a first motor (for example axial flux motor 16) and a second motor (for example radial flux motor 22 to a body having a member for generating air flow (for example a squirrel cage blower 26 having a fin 28).

The common adapter 46 as shown has a two-piece construction with a flange 54 and a central hub 56 fitted to opening 62 in the flange 54. Such a two-piece construction permits the two different components to be made with different and more efficient manufacturing methods. For example, the flange may be made from a stamping and the hub 56 may be cast.

It should be appreciated that the flange may be cast or machined from a solid or made in any other commercially feasible manner. For example and as shown in FIG. 4, the flange 54 may be made of a first component 53 and a second component 55. The components 53 and 55 may be stamped or molded and the mounting holes 60 and the opening 62 may be stamped, punched or mold or removed in any known manufacturing process. The components 53 and 55 may be glued, formed, welded or secured together with any known manufacturing process. The components 53 and 55 may form a v-shaped periphery 57 for use to connect the flange 54 to the members 28.

It should also be appreciated that the hub may be stamped or machined from a solid or made in any other commercially feasible manner. The hub and the flange may be made of any suitable durable materials and maybe made of a polymer, a metal, a composite material or any combination thereof.

It should be appreciated that if the common adapter is made with a flange and a central hub, the common adapter may be used with the axial flux motor 16 without the hub. The flange itself may serve to be an adapter for use with the axial flux motor 16. The hub may be added to the flange if the common adapter is used to connect the blower 26 to the radial flux motor 22.

Referring again to FIGS. 3 and 4, the flange 54 may have any suitable shape to provide, the axial flux motor connector 50 and the blower or body connector 48. The flange 54 also includes a connector for the hub 56 in the form of, for example, central opening 62.

As shown in FIG. 4, the flange 54 may include an axial flux motor mounting face 64 for mounting the axial flux motor 16 thereto. The mounting face 64 is located on central disk shaped portion 66 of the flange 54. The flange 54 may also include an outer inclined stiffening portion 68 that, as shown, extends radially outwardly and axially inwardly from the mounting face 64. The flange 54 may also include an outer disk shaped portion 65 that as shown extends radially outwardly from the outer inclined stiffening portion 68.

The flange 54 may also include an inner inclined stiffening portion 67 that as shown extends radially inwardly and axially outwardly from the mounting face 64. The inner inclined stiffening portion 67 may include recessed portions 70 that extend to the central disk shaped portion 66. The recessed portions 70 may be centered around the holes 60 in the adapter and are used to permit the fasteners 58 to engage threads 72 formed in the holes 60 (see FIG. 9) used to secure the axial flux motor 16 to the adapter 46.

The flange 54 may also include an inner disk shaped portion 69 that as shown extends radially inwardly from the inner inclined stiffening portion 67. The inner disk shaped portion 69 defines the central opening 62. The central opening 62 is sized to receive cylindrical outer periphery 74 of the hub 56. The hub may be threadably secured to the adapter 46 or may be interferencely fitted to the adapter 46. The hub 56 may be secured to the adapter 46 crimping, by welding, or any other commercially available method.

The adapter 46, as shown, further include outer disk shaped portion 65 extending from outer inclined stiffening portion 68 of the flange 54. The body connecter 48 may have any suitable shape and may, as shown, be in the form of v-shaped periphery 57 that extends outwardly from the outer disk shaped portion 65 and is used to connect the adapter 46 to the body or blower 26.

The hub 56 may any suitable shape capable of securing the shaft 24 of the radial flux motor 22 to the adapter 46.

Figure 5:
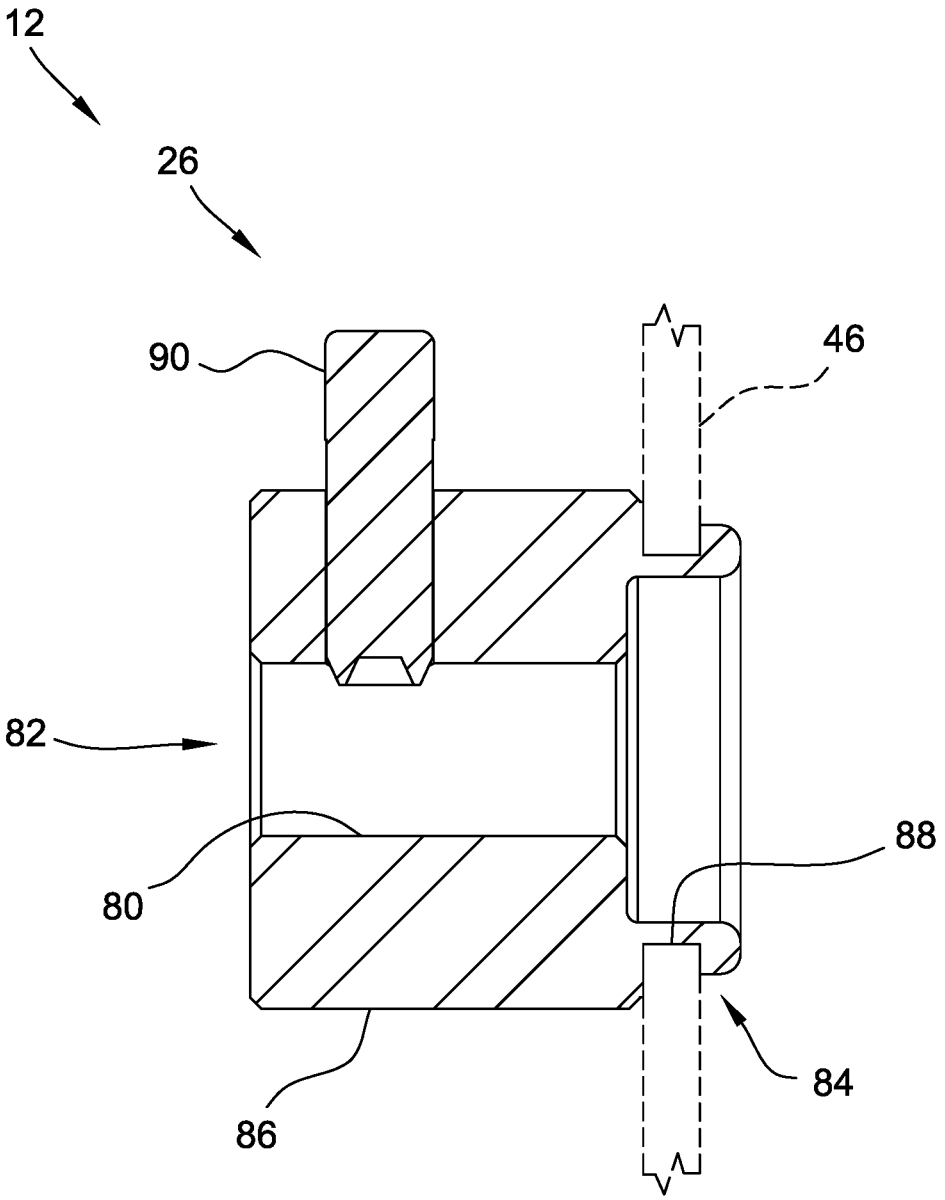
FIG. 5 is cross sectional view of the hub for the adapter for of FIG. 3.

For example and as shown in FIG. 5, the hub 56 may include an inner periphery 80 which provides opening 62 for receiving the shaft 24 of radial flux motor 22. The hub 56 may also include a groove 84 formed on the outer periphery 74 of the hub 56. The groove 84 may be used to secure the hub 56 to an inner periphery 88 of the adapter 46. The adapter 46 and/or the hub 56 may be deflected or deformed to fit the adapter 46 in the groove 84 of the hub 56. The adapter 46 and the hub 56 may be press fitted together or may be connected by a combination of freezing and heating the adapter 46 and the hub 56. A setscrew 90 may be threadably connect to the hub 56 and may be used to secure the shaft 24 to the hub 56.

Figure 6:
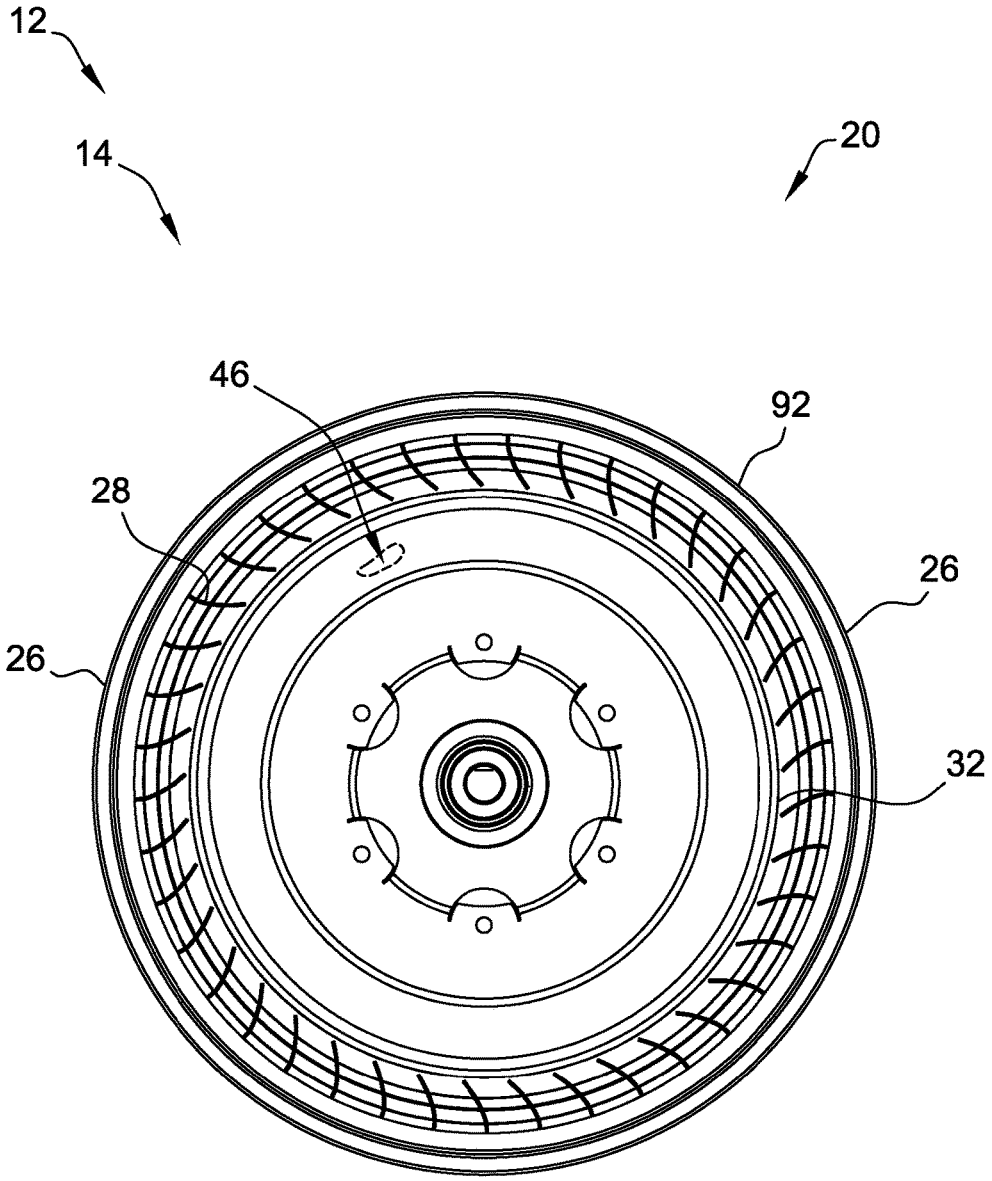
FIG. 6 is a plan view of a blower assembly for use in the kit of FIG. 1 using the adapter of FIG. 3 and the blower of FIG. 1.
Figure 7A:
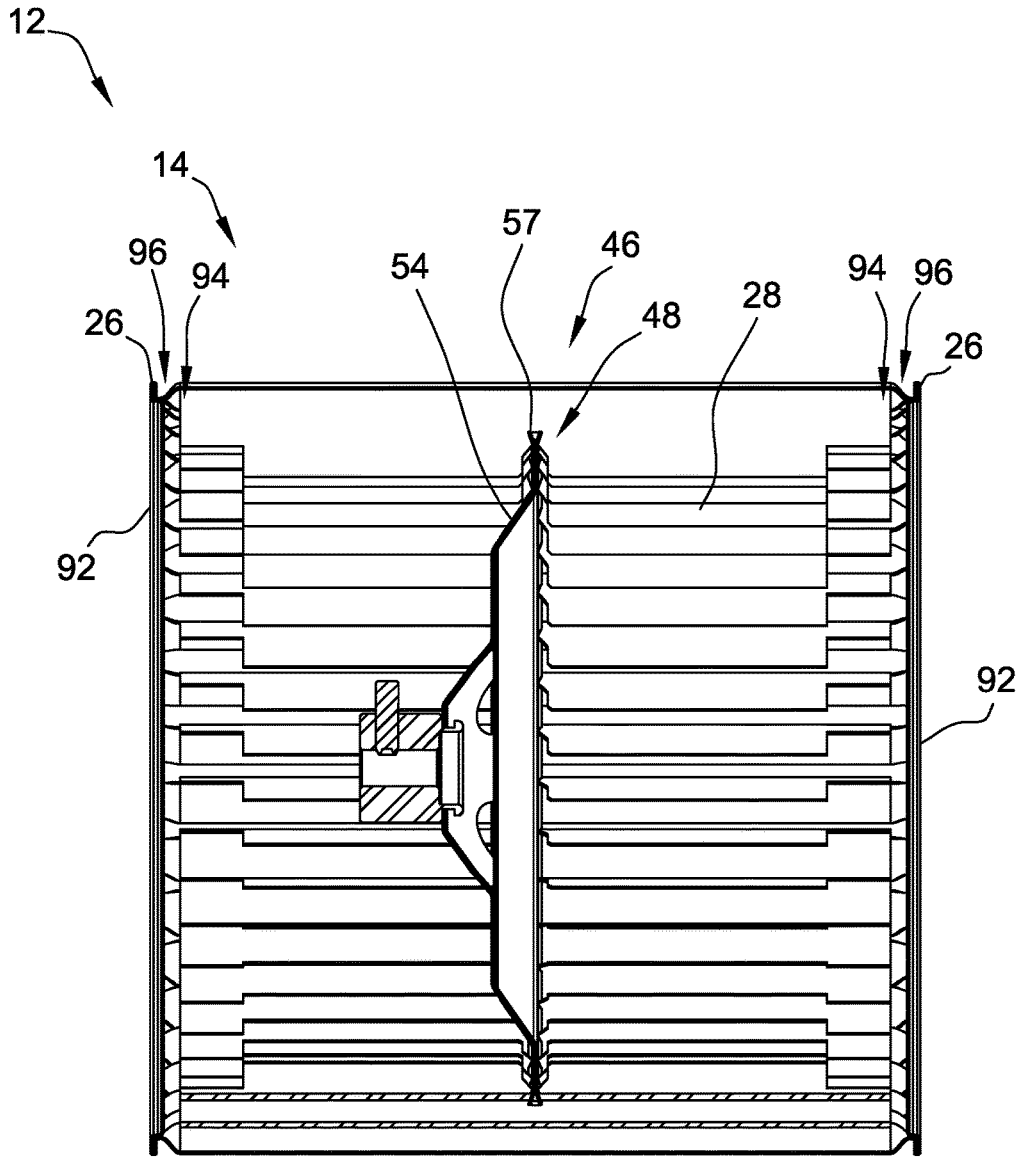
FIG. 7A is a cross sectional view of the assembly of FIG. 6.
Figure 7B:
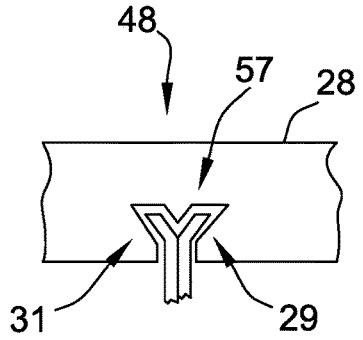
FIG. 7B is a partial cross sectional view of the assembly of FIG. 6 showing the body connector in greater detail.

Referring now to FIGS. 6 and 7, the first blower assembly 14 is shown in detail. Note that the plurality of blower assemblies 12 shown in FIG. 1 may include the first blower assembly 14 and the second blower assembly 20. Also, note that the first blower assembly 14 and the second blower assembly 20 may be identical or different.

As shown in FIGS. 6 and 7, the body 26, the common adapter 46 and the member 28 form the first blower assembly 14. The common adapter 46 may be in the form of a center plate that serves to support the body 26. As shown in FIGS. 6 and 7, the body 26 is in the form of end rings 92. A plurality of spaced apart members 28 in the form of blades or fins extend axially from a first of the end rings 92 to a second of the end rings 92. The blades 28 are connected to the end rings 92 in any suitable fashion. For example and as shown, the blades 28 include end portions 94 that are sandwiched between portions 96 of the end rings 92.

While the first blower assembly 14 may be configured in any manner such that the body 26, the center plate 46 and the blades 28 form the first blower assembly 14, as shown, the blades 28 are connected to the flange 54 at the v-shaped periphery 57 of flange 54. While the center plate 46 may be positioned along the length of the blades 28 anywhere that provides for a sturdy construction, the center plate 46, as shown in FIG. 7, is centrally positioned along the length of the blower assembly 14.

As shown in FIG. 7A, the v-shaped periphery 57 of flange 54 may, as shown, serve as the body connection 48 of center plate 46. The blades 28 may include a matching flange-receiving v-shaped periphery 29 on inner edge 31 of the blades 28. The blades 28 may merely contact the flange 54 at periphery 29, or may be welded, glued or otherwise secured to the flange 54. The blades 28, end rings 92 and the center plate 46 form the wheel or squirrel cage 93.

The blades 28 may have any shape conducive to generating airflow. As shown, the blades 28 are positively included, but may be neutral or negatively inclined with respect to the direction of rotation of the wheel 93.

Figure 8:
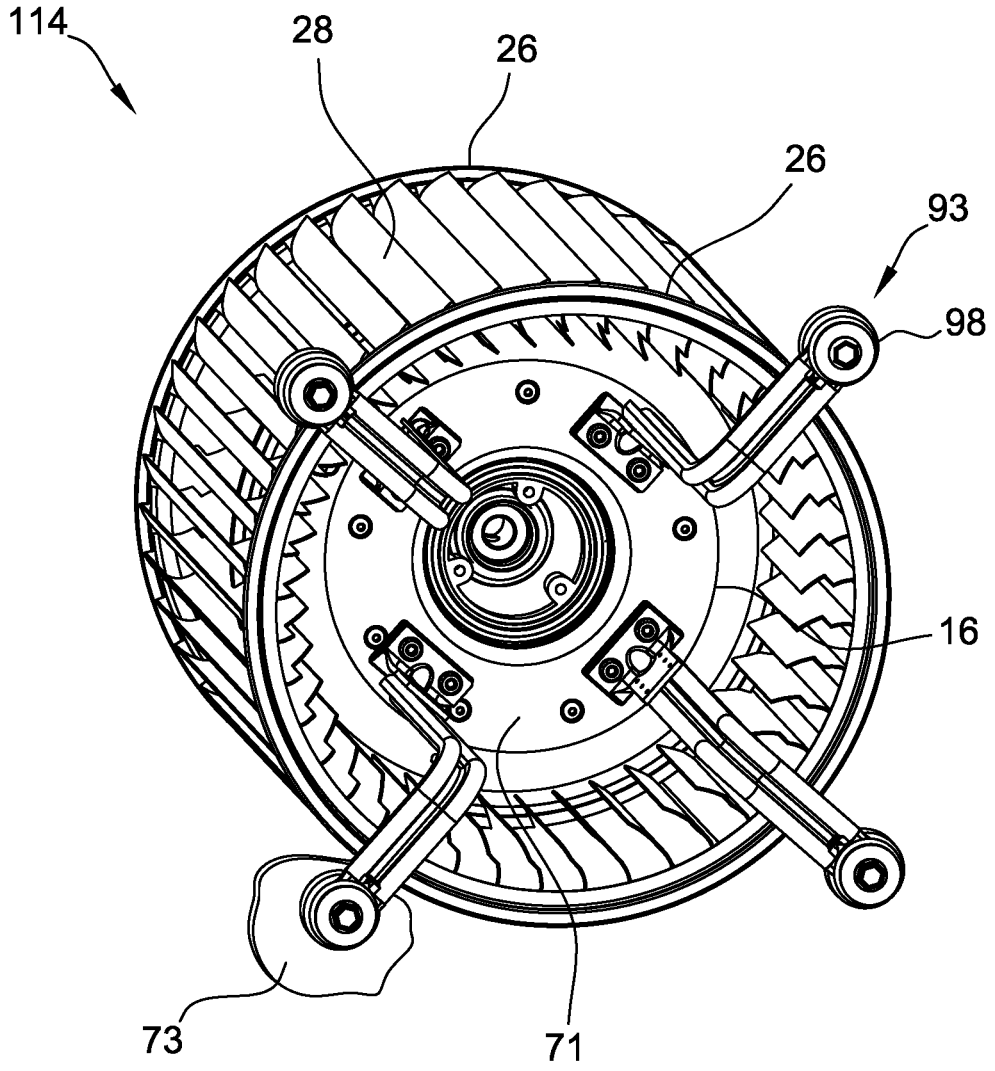
FIG. 8 is a perspective view of a blower assembly assembled from the blower assembly kit of FIG. 1 and utilizing an axial flux motor.
Figure 9:
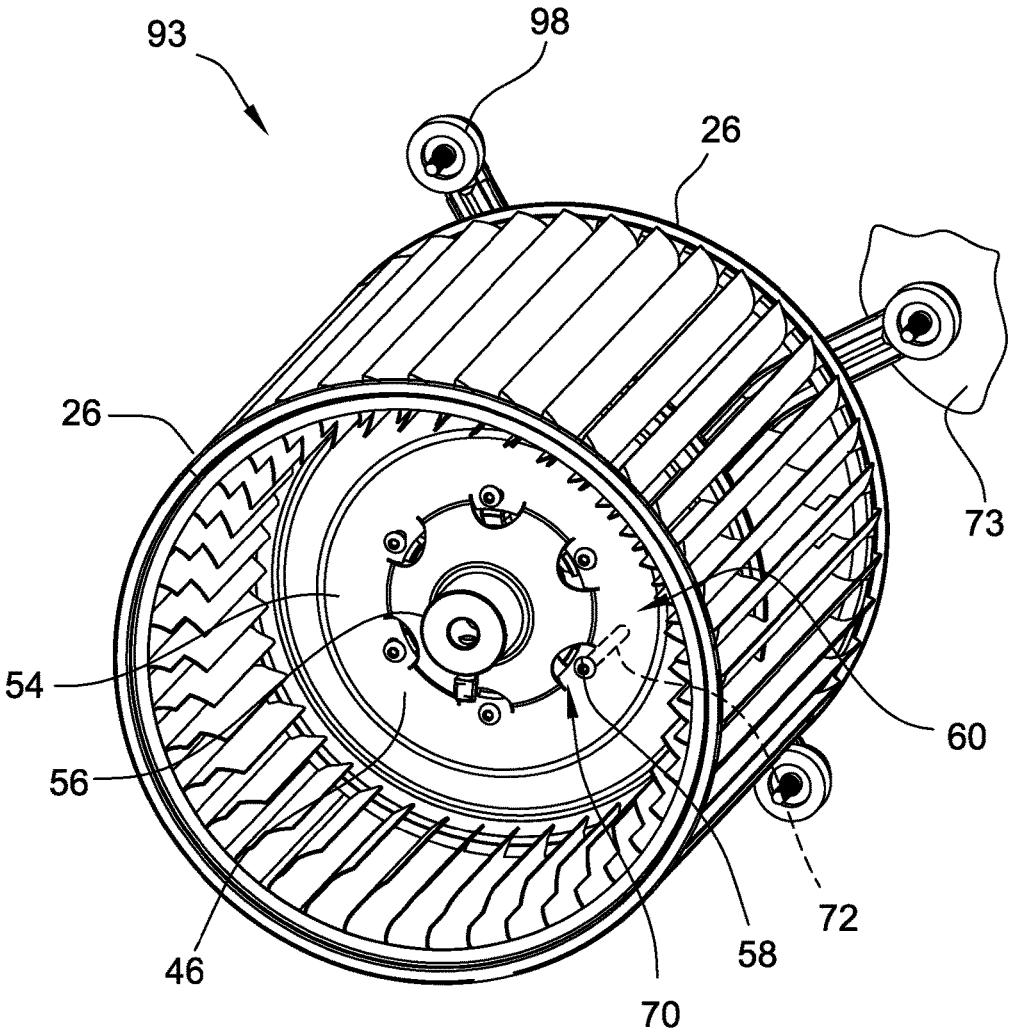
FIG. 9 is another perspective view of the blower assembly of FIG. 8.
Figure 10:
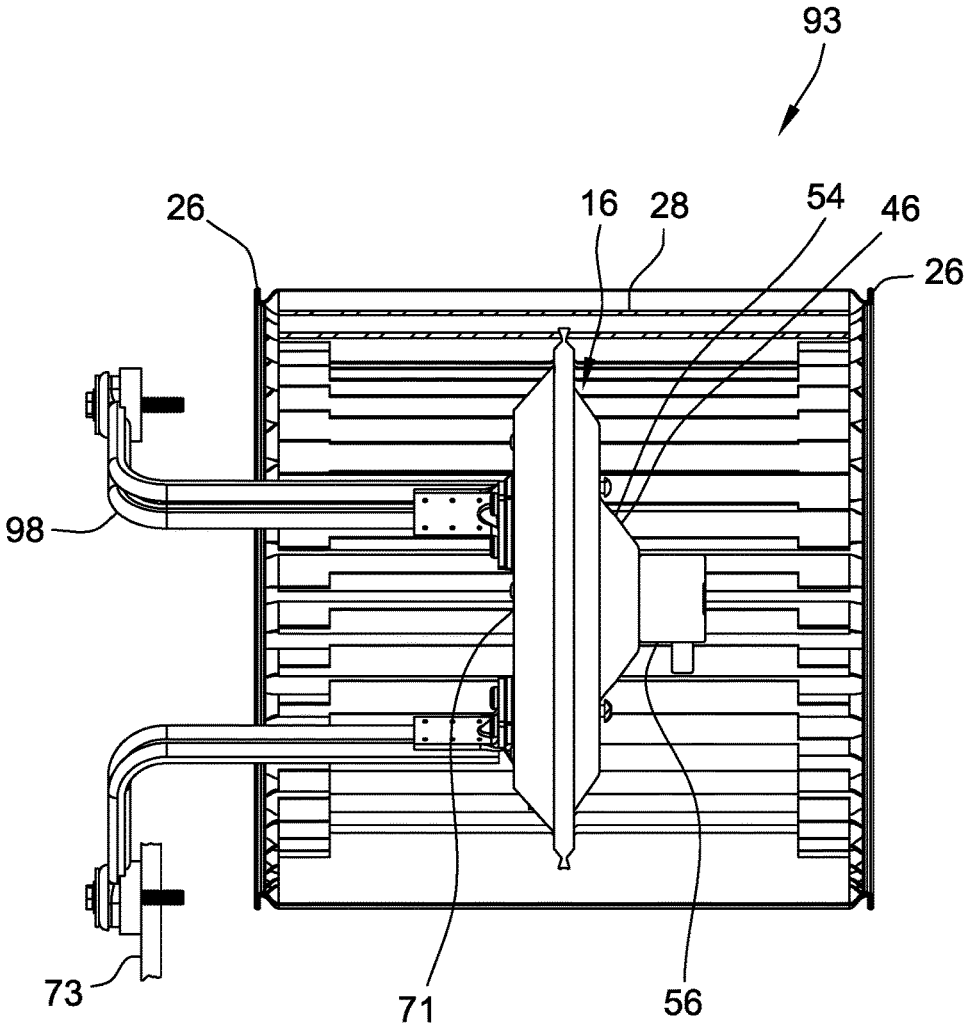
FIG. 10 is another plan view of the blower assembly of FIG. 8, with the axial flux motor partially cut away.

Referring now to FIGS. 8-10, the first blower assembly 114 is shown in detail. Note that the plurality of blower assemblies 112 shown in FIG. 2 may include the first blower assembly 114 and the second blower assembly 120. Also, note that the first blower assembly 114 and the second blower assembly 120 are different in that the first blower assembly 114 includes first or axial flux motor 16, while the second blower assembly 120 includes second or radial flux motor 22.

As shown in FIGS. 8-10, the body or end rings 26, the center plate 46, the blades 28, and the first or axial flux motor 16 form the first blower assembly 114. As shown in FIGS. 8-10, the first blower assembly 114 may also include blower housing 73 and a mounting arrangement 98 in the form of, for example, mounting legs connected to housing 71 of the motor 16 and to blower housing 73.

As shown in FIG. 10, the hub 56 of the center plate 46 is not required for the center plate 46 of the first blower assembly 114, as the axial flux motor 16 does not need a connection to the hub 56. The hub 56 may be included on this configuration to provide for simplicity, lower center plate inventory and fewer part numbers for manufacturers of both first blower assembly 114 and second blower assembly 120. Alternatively, the hub 56 may be removed from center plate 46 of the first blower assembly 114 to reduce cost.

Figure 11:
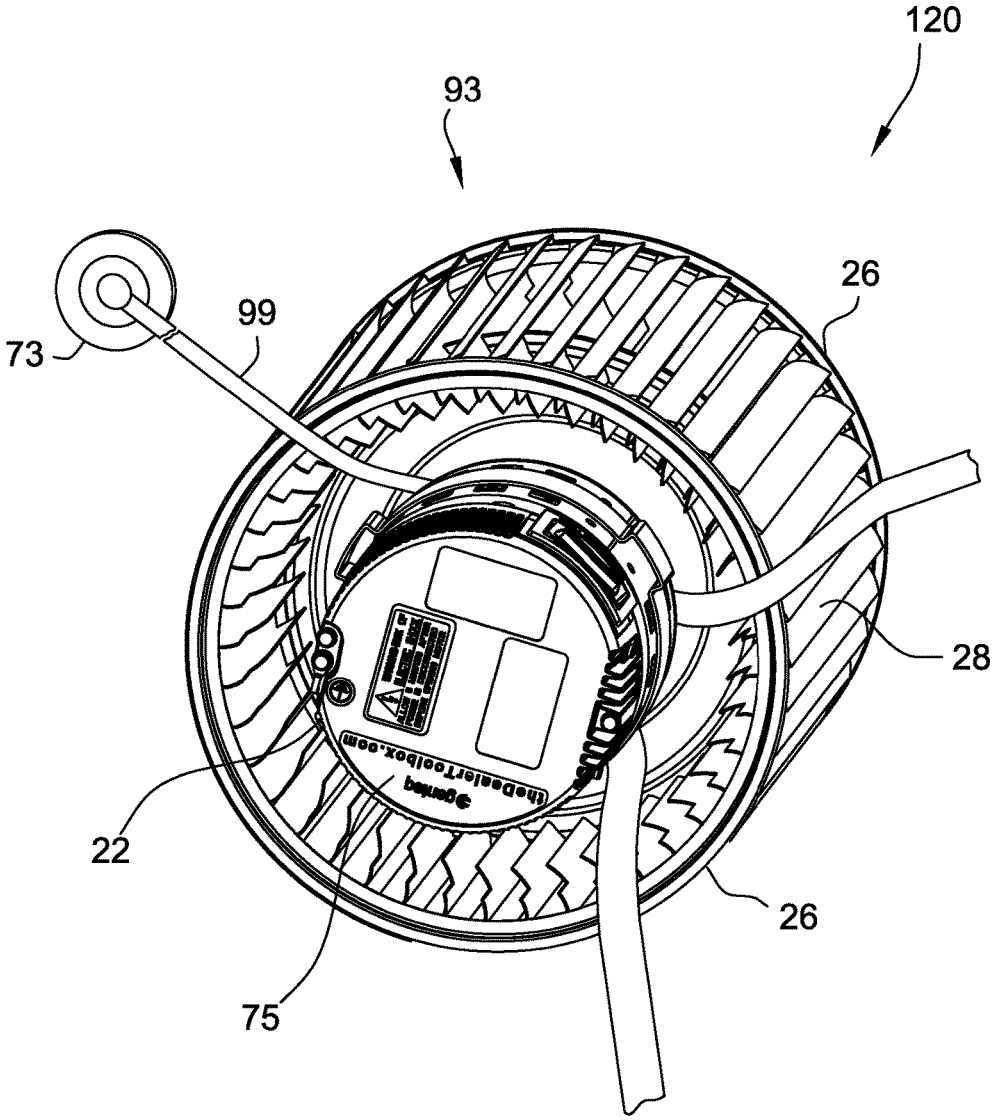
FIG. 11 is a perspective view of another blower assembly assembled from the blower assembly kit of FIG. 1 and utilizing a radial flux motor.
Figure 12:
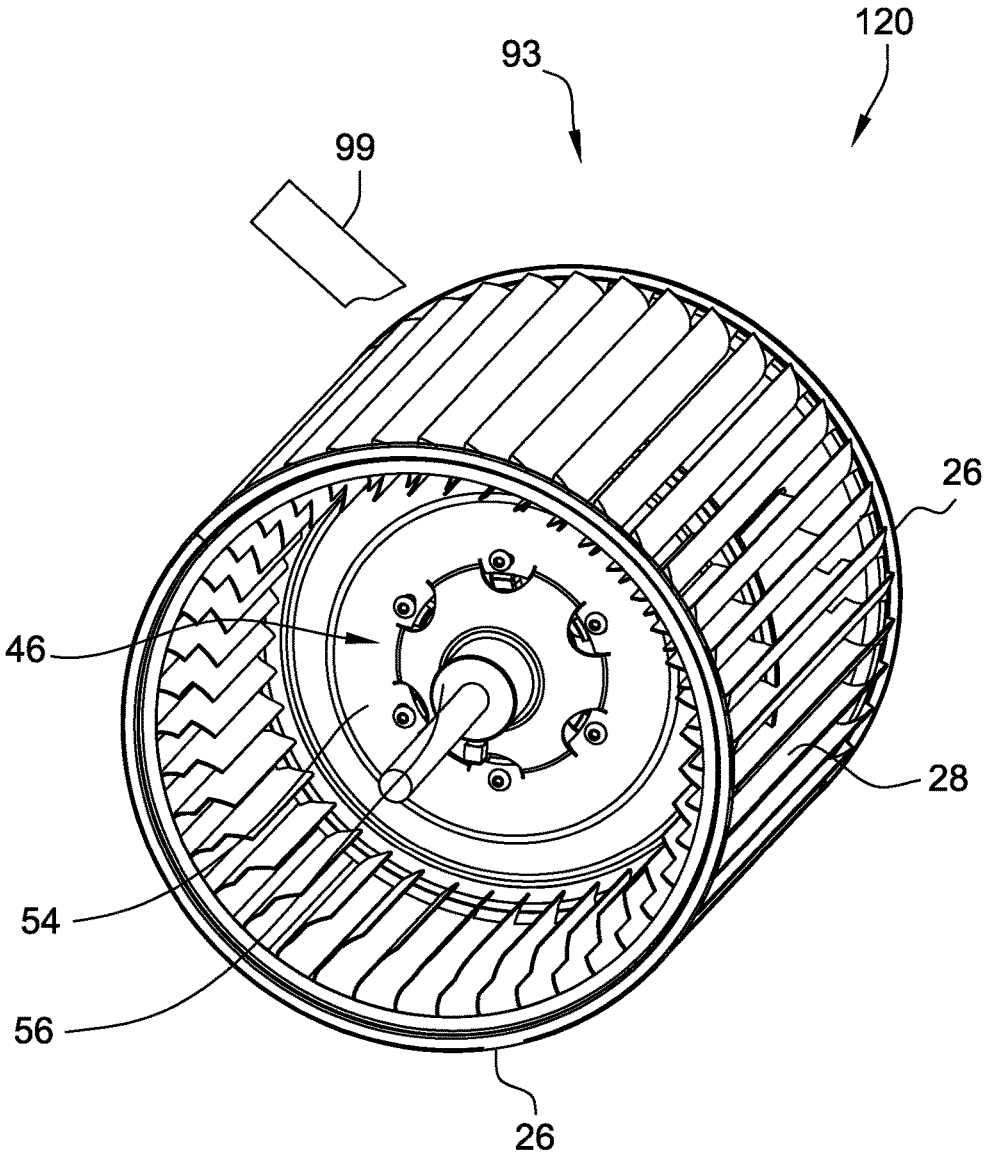
FIG. 12 is another perspective view of the blower assembly of FIG. 11.
Figure 13:
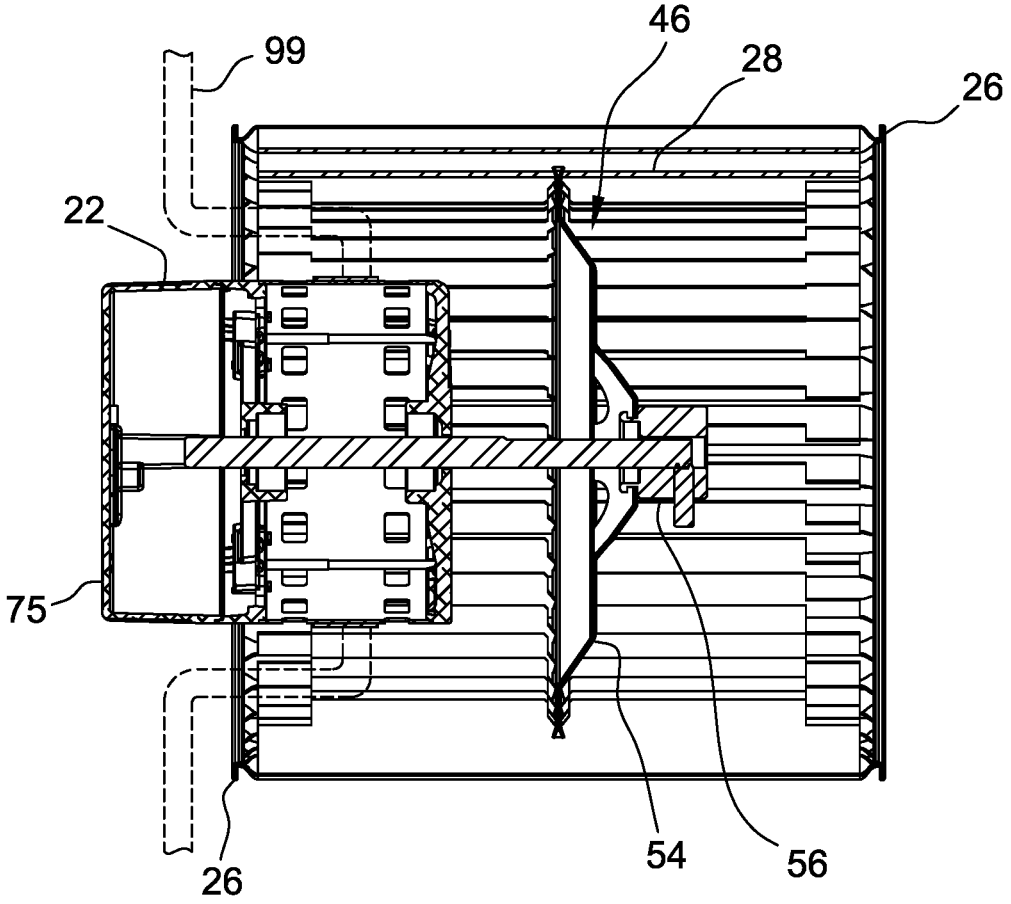
FIG. 13 is another plan view of the blower assembly of FIG. 11, partially cut away.

Referring now to FIGS. 11-13, the second blower assembly 120 is shown in greater detail. Note that the plurality of blower assemblies 112 shown in FIG. 2 may include the first blower assembly 114 and the second blower assembly 120. Also, note that the first blower assembly 114 and the second blower assembly 120 are different in that the first blower assembly 114 includes first or axial flux motor 16, while the second blower assembly 120 includes second or radial flux motor 22.

As shown in FIGS. 11-13, the body or end rings 26, the center plate 46, the blades 28, and the second or radial flux motor 22 form the second blower assembly 120. As shown in FIGS. 11-13, the second blower assembly 120 may also include blower housing 73 and a mounting arrangement 99 in the form of, for example, a belly band connected to housing 75 of the motor 22 and mounting legs connected to blower housing 73.

Figure 14:
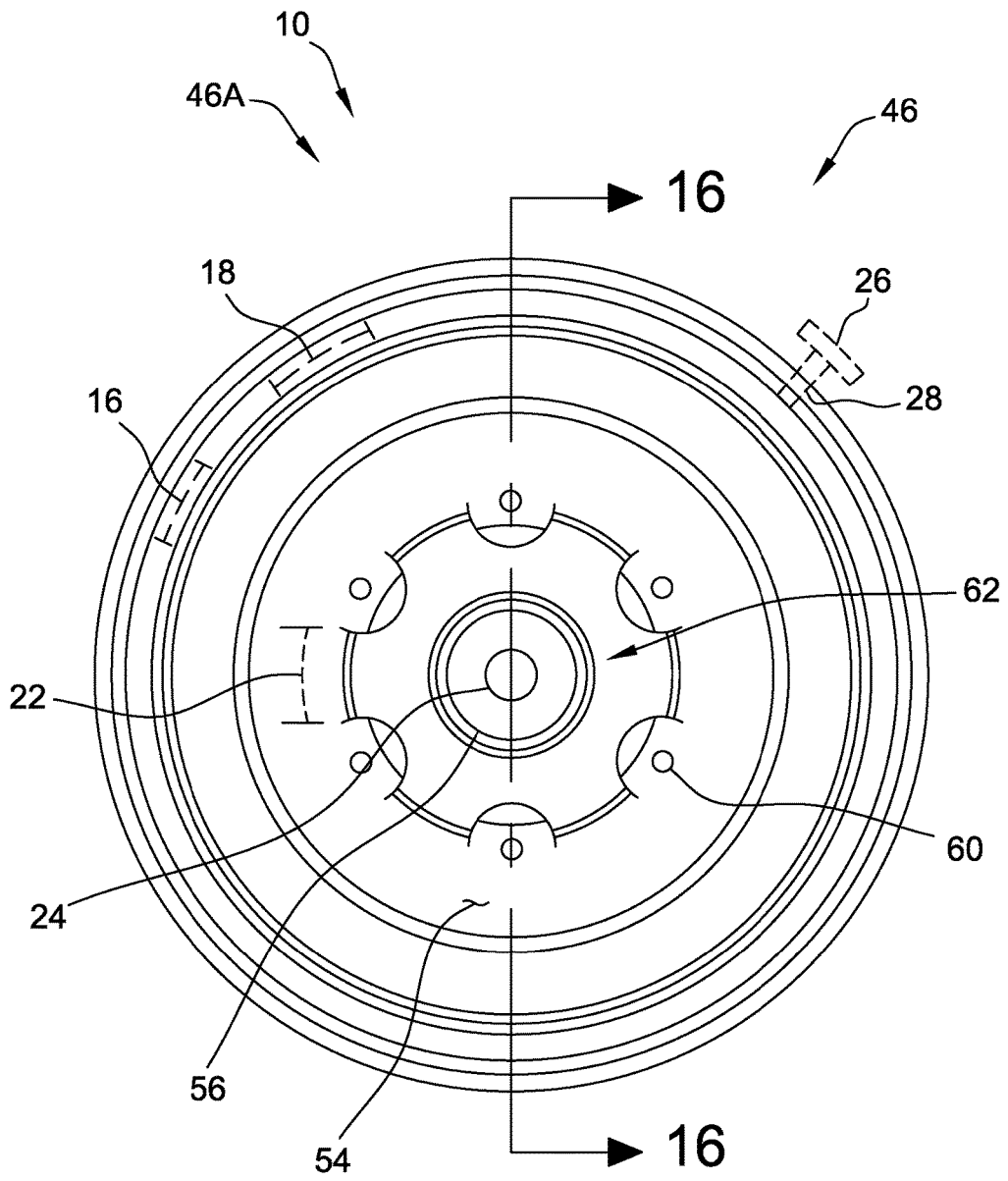
FIG. 14 is plan view of the adapter of FIG. 1 with an integral hub.
Figure 15:
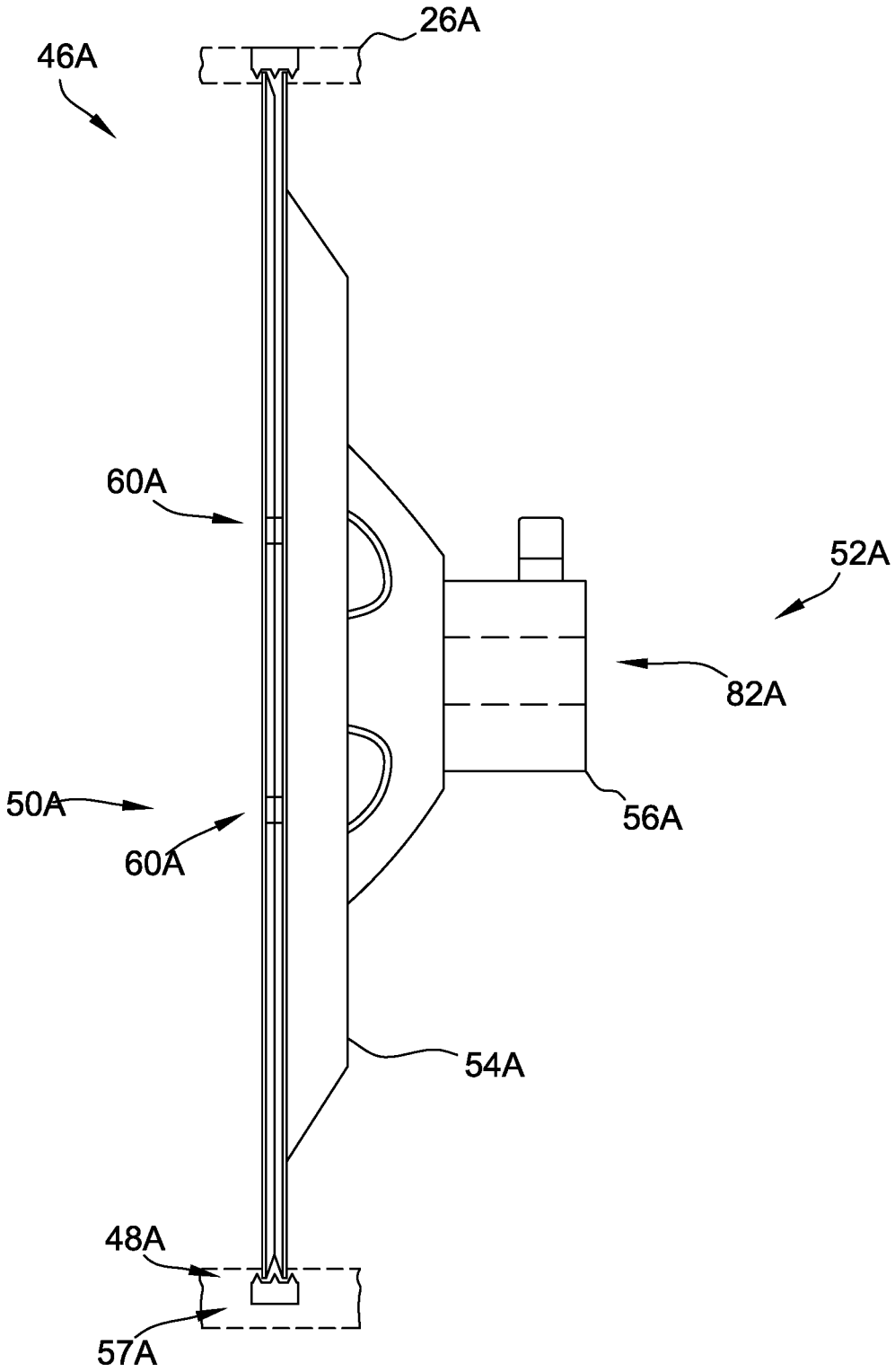
FIG. 15 is a side view of the adapter of FIG. 14.
Figure 16:
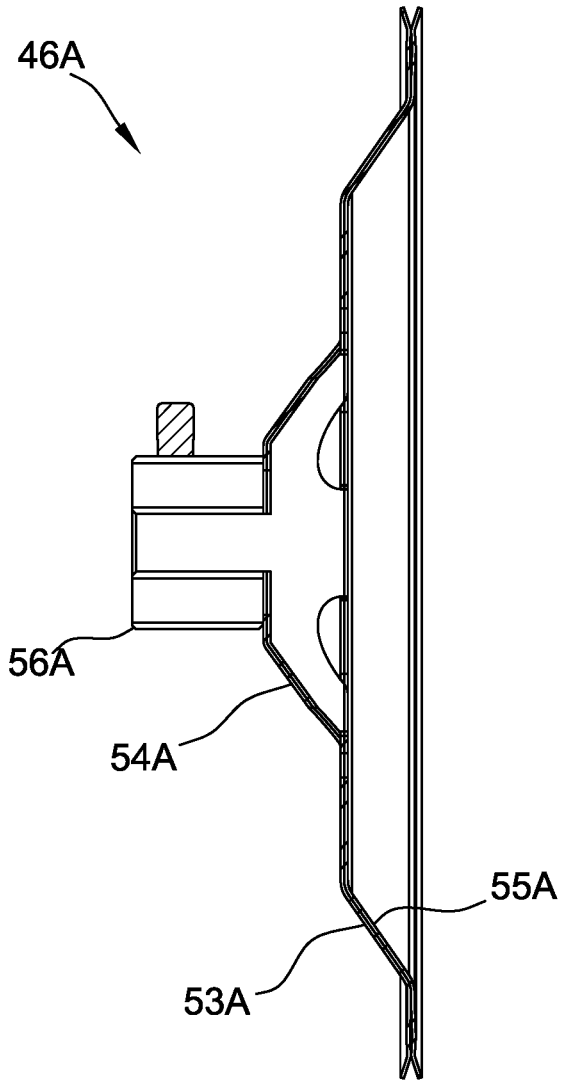
FIG. 16 is a cross sectional view of the adapter of FIG. 14 along the line 16-16 in the direction of the arrows.

Referring now to FIGS. 14-16, one-piece center plate 46A of FIG. 1 is shown in greater detail. The center plate 46A may have any suitable shape and be made of any suitable durable material capable of securing a selected one of a first motor (for example axial flux motor 16) and a second motor (for example radial flux motor 22 to a body having a member for generating air flow (for example a squirrel cage blower 26 having a blade or fin 28) (see FIG. 1).

Referring again to FIGS. 14-16, the center plate 46A as shown has a one-piece construction (note two stamping, as shown, may be use to provide this one-piece construction). The center plate 46A has a flange 54A and a central hub 56A that are integral with each other.

It should be appreciated that the center plate 46A may be cast or machined from a solid or made in any other commercially feasible manner. For example and as shown in FIG. 16, the center plate 46A may be made of a first component 53A and a second component 55A. The components 53A and 55A may be stamped or molded and the mounting holes 60A and the opening 62A may be stamped, punched or mold or removed in any known manufacturing process. The components 53A and 55A may be glued, formed, welded or secured together with any known manufacturing process. The components 53A and 55A may form a v-shaped periphery 57A for use to connect the flange 54A to the members 28.

It should also be appreciated that the center plate 46A may be stamped or machined from a solid or made in any other commercially feasible manner. The center plate 46A may be made of any suitable durable materials and maybe made of a polymer, a metal, a composite material or any combination thereof.

Referring again to FIGS. 14-16, the center plate 46A may have any suitable shape to provide, the axial flux motor connector 50A and the blower or body connector 48A. The center plate 46A may have a shape similar to that of center plate 46 of FIGS. 3-4. The center plate 46A may also include a radial flux motor connector 52A in the form of, for example, central opening 62A.

Figure 17A:
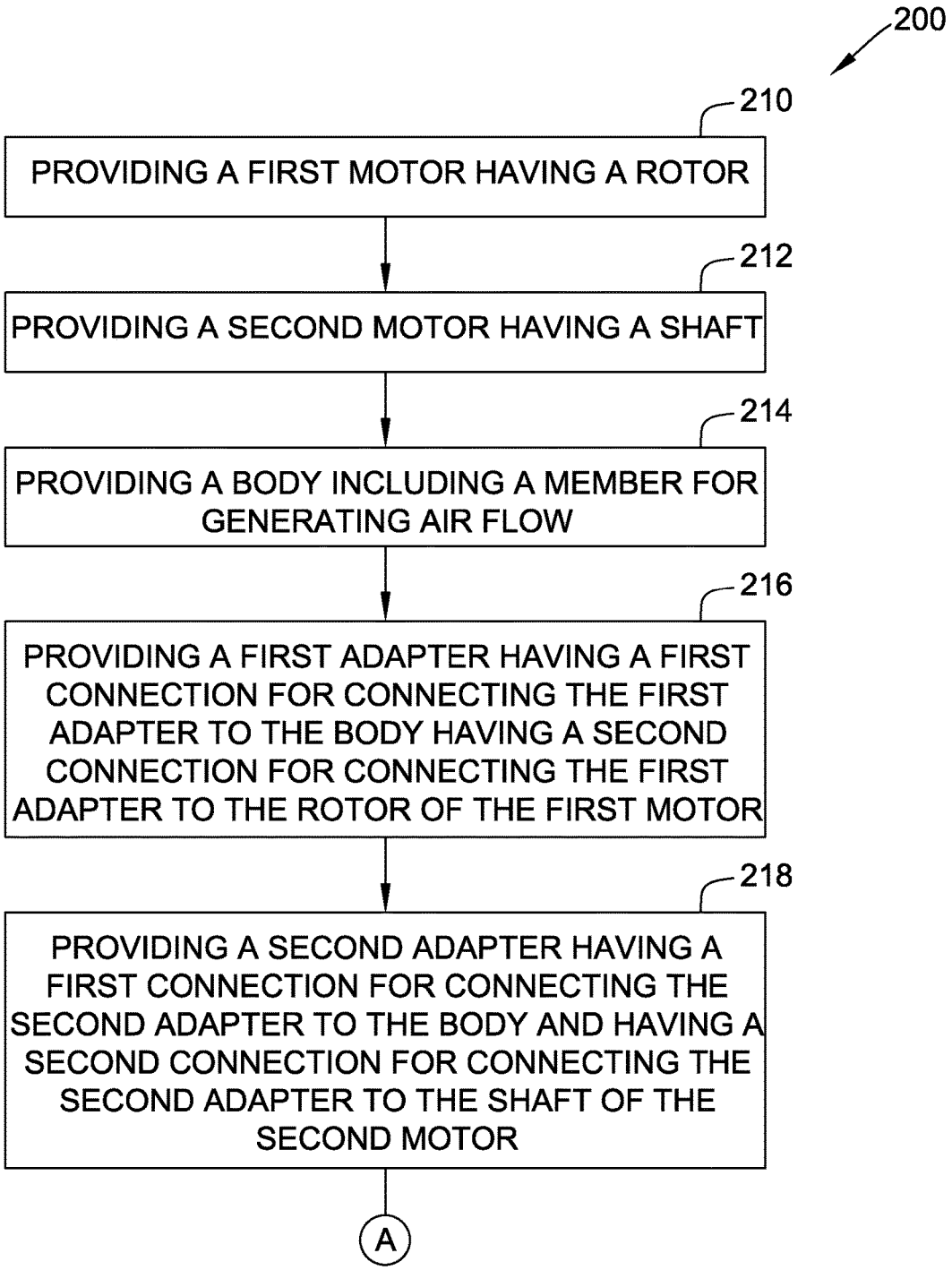
FIG. 17A is a first portion of a flow chart of another embodiment of the present invention in the form of a method for providing a HVAC blower.
Figure 17B:
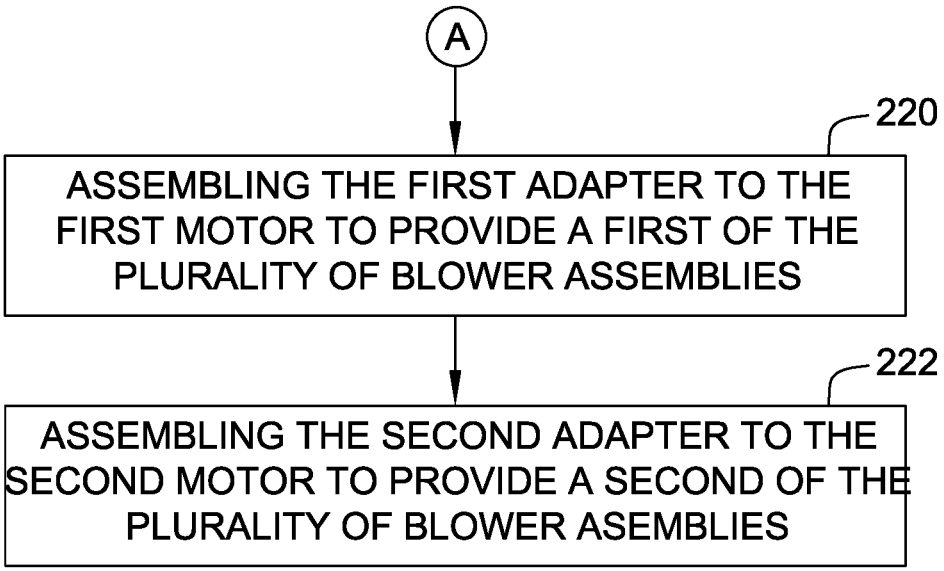
FIG. 17B is a second part of the flow chart of FIG. 17A.

According to another embodiment of the present invention and referring now to FIGS. 17A and 17B, a method 200 for providing a plurality of blower devices is provided. The method includes step 210 of providing a first motor having a rotor and step 212 of providing a second motor having a shaft. The method also includes step 214 of providing a body including a member for generating air flow and step 216 of providing a first adapter having a first connection for connecting the first adapter to the body and having a second connection for connecting the first adapter to the rotor of the first motor. The method also includes step 218 of providing a second adapter having a first connection for connecting the second adapter to the body and having a second connection for connecting the second adapter to the shaft of the second motor and the step 220 of assembling the first adapter to the first motor to provide a first of the plurality of blower assemblies. The method further includes step 222 of assembling the second adapter to the second motor to provide a second of the plurality of blower assemblies.

When introducing elements/components/etc. of the methods and apparatus described and/or illustrated herein, the articles "a", "an", "the", and "the" are intended to mean that there are one or more of the element(s)/component(s)/etc. The terms "comprising", "including", and "having" are intended to be inclusive and mean that there may be additional element(s)/component(s)/etc. other than the listed element(s)/component(s)/etc.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

Described herein are exemplary methods, systems and apparatus utilizing lower cost materials in a permanent magnet machine that reduces or eliminates the efficiency loss caused by the lower cost material. Furthermore, the exemplary methods system and apparatus achieve increased efficiency while reducing or eliminating an increase of the length of the machine. The methods, system and apparatus described herein may be used in any suitable application. However, they are particularly suited for HVAC applications.

Exemplary embodiments of the fluid flow device and system are described above in detail. The electric machine and its components are not limited to the specific embodiments described herein, but rather, components of the systems may be utilized independently and separately from other components described herein. For example, the components may also be used in combination with other machine systems, methods, and apparatuses, and are not limited to practice with only the systems and apparatus as described herein. Rather, the exemplary embodiments can be implemented and utilized in connection with many other applications.

Although specific features of various embodiments of the disclosure may be shown in some drawings and not in others, this is for convenience only. In accordance with the principles of the disclosure, any feature of a drawing may be referenced and/or claimed in combination with any feature of any other drawing.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A blower assembly kit for fabricating a plurality of blower assemblies, a first of the plurality of blower assemblies configured for use with a first motor having a rotor and a second of the plurality of blower assemblies configured for use with a second motor having a shaft, the kit comprising:

a body including a member for generating air flow;

a first adapter having a first connection for connecting said first adapter to said body and having a second connection for connecting said first adapter to the rotor of the first motor; and a second adapter having a first connection for connecting said second adapter to said body and having a second connection for connecting said second adapter to the shaft of the second motor, whereby said body and said first adapter include the first of the plurality of blower assemblies and whereby said body and said second adapter include the second of the plurality of blower assemblies.

2. The blower assembly kit in accordance with claim 1, wherein said second adapter comprises a first member including the first connection and a second member, connected to the first member and including the second connection.

3. The blower assembly kit in accordance with claim 2, wherein the first member of said first adapter is integral with said second adapter.

4. The blower assembly kit in accordance with claim 1, wherein said first adapter and said second adapter are integral with each other.

5. The blower assembly kit in accordance with claim 1, wherein the first motor is an axial flux motor.

6. The blower assembly kit in accordance with claim 1, wherein the second motor is a radial flux motor.

7. The blower assembly kit in accordance with claim 1, wherein the second connection of said second adapter comprises a hub defining a central opening for receiving the shaft.

8. The blower assembly kit in accordance with claim 7 further comprising a fastener, wherein the second connection of said first adapter includes an opening for receiving said fastener.

9. The blower assembly kit in accordance with claim 1 further comprising a plurality of fasteners, wherein the second connection of said first adapter comprises a plurality of spaced apart openings, each opening adapted for receiving at least one of said fasteners, and wherein said rotor comprises a plurality of spaced apart openings, each opening adapted for receiving at least one of said fasteners.

10. The blower assembly kit in accordance with claim 1 wherein the body comprises a blower wheel, and wherein the member comprises a blower blade.

11. The blower assembly kit in accordance with claim 1 wherein the body comprises a fan body, and wherein the member comprises a fan blade.

12. A device kit for fabricating a plurality of blower devices, the kit comprising:

a first motor having a rotor;

a second motor having a shaft;

a body including a member for generating air flow;

a first adapter having a first connection for connecting said first adapter to said body and having a second connection for connecting said first adapter to the rotor of said first motor; and a second adapter having a first connection for connecting said second adapter to said body and having a second connection for connecting said second adapter to the shaft of said second motor, whereby said body, said first adapter and said first motor include a first of the plurality of blower devices and whereby said body, said second adapter and said second motor include the second of the plurality of blower devices.

13. The device kit in accordance with claim 12, wherein said second adapter comprises a first member including the first connection and a second member, connected to the first member and including the second connection.

14. The device kit in accordance with claim 12, wherein said first adapter and said second adapter are integral with each other.

15. The device kit in accordance with claim 12, wherein a first member of said first adapter is integral with said second adapter.

16. The device kit in accordance with claim 12, wherein the first motor is an axial flux motor.

17. The device kit in accordance with claim 12, wherein the second motor is a radial flux motor.

18. The device kit in accordance with claim 12, wherein the second connection of said second adapter comprises a hub defining a central opening for receiving the shaft.

19. The device kit in accordance with claim 12, wherein said rotor comprises a plurality of spaced apart openings, each opening adapted for receiving at least one of said fasteners.

20. A method for providing a plurality of blower devices, said method comprising the steps of:

providing a first motor having a rotor;

providing a second motor having a shaft;

providing a body including a member for generating air flow;

providing a first adapter having a first connection for connecting the first adapter to the body and having a second connection for connecting the first adapter to the rotor of the first motor;

providing a second adapter having a first connection for connecting the second adapter to the body and having a second connection for connecting the second adapter to the shaft of the second motor;

assembling the first adapter to the first motor to provide a first of the plurality of blower devices; and assembling the second adapter to the second motor to provide a second of the plurality of blower devices.

* * * * *